US006504468B2

(12) United States Patent
Lee et al.

(10) Patent No.: US 6,504,468 B2
(45) Date of Patent: Jan. 7, 2003

(54) POWER FUSE BLOCK

(75) Inventors: Kendrew Lee, Fremont, CA (US); Noel Lee, Daley City, CA (US); Rusty Everett, San Mateo, CA (US)

(73) Assignee: Monster Cable Products, Inc., Brisbane, CA (US)

( * ) Notice: Subject to any disclaimer, the term of this patent is extended or adjusted under 35 U.S.C. 154(b) by 108 days.

(21) Appl. No.: 09/754,854

(22) Filed: Jan. 4, 2001

(65) Prior Publication Data

US 2002/0105407 A1 Aug. 8, 2002

(51) Int. Cl.[7] ..... H01H 85/175; H01H 85/143; H01R 33/95

(52) U.S. Cl. ..... 337/187; 337/186; 337/194; 361/833; 361/837; 439/622

(58) Field of Search ..... 337/186, 187, 337/194, 195; 439/621, 622, 890; 361/626, 642, 646, 833, 837

(56) References Cited

U.S. PATENT DOCUMENTS 3,993,395 A * 11/1976 Taylor ..... 439/698
4,050,045 A * 9/1977 Motten et al. ..... 337/166
4,503,131 A * 3/1985 Baudrand ..... 200/266
5,167,541 A * 12/1992 Alves et al. ..... 337/186
5,328,392 A * 7/1994 Lin et al. ..... 439/621
5,618,209 A * 4/1997 Lin et al. ..... 439/621
5,888,098 A * 3/1999 Cheng et al. ..... 439/621
6,004,159 A * 12/1999 Liang ..... 439/621
6,162,097 A * 12/2000 Liang ..... 439/218

FOREIGN PATENT DOCUMENTS

JP 10-223125 A * 9/1998 ..... H01H/85/22

OTHER PUBLICATIONS

Electric Utility Engineering Reference Book; Distribution Systems, Vo. 3, p. 393, Westinghouse Electric Corporation (1965).

William H. Crouse and Donald L. Anglin, Automotive Mechanics, 10$^{th}$ Ed., pp. 343–344, Glencoe McGraw–Hill (1995).

* cited by examiner

*Primary Examiner*—Anatoly Vortman
(74) *Attorney, Agent, or Firm*—LaRiviere, Grubman & Payne, LLP

(57) ABSTRACT

A method for highly reliable and durable electrical power distribution and a fusing block assembly for distribution of large electric currents to electricity-consuming devices. The invention is a machined block (10) of conductive material into which threaded connectors (20) for input wires are affixed through the use of slip-joint ferrules (23) which allow the connectors (20) to be tightened securely to block (10) without twisting the wires. Threaded output connectors (30) hold fuses (70) which are joined to output wire connector assemblies (40). The output wire connector assemblies (40) also include slip-joint ferrules (51) which allow the connectors (40) to be tightened securely without twisting the wires.

20 Claims, 3 Drawing Sheets

POWER FUSE BLOCK

TECHNICAL FIELD

The present invention relates generally to electrical power safety fusing devices and more particularly, to fuse holding blocks for high current electrical distribution.

BACKGROUND OF THE INVENTION

Fuses and fusible links, as well as circuit breakers, are circuit protection devices which create an open circuit for protecting a peripheral device in the event of over-current.[1] Typically, fuses are utilized in a manner such as "cartridge fuse" which contains a conductive strip coupled at the ends to fuse caps. Such fuses are usually installed in either a fuse block or a fuse panel. However, such related art fuse blocks and fuse panels are formed from an electrically insulating material and function as a mere housing for the fuses.[2] Thus, a need for an apparatus and method comprising a new fuse block formed from an electrically conductive material which accommodates power fuses, in particular, and which facilitates high current power distribution to peripheral devices is seen to exist.

[1]Electric Utility Engineering Reference Book: Distribution Systems, Vol. 3, p. pp. 393–393, Westinghouse Electric Corporation (1965).

[2]William H. Crouse and Donald L. Anglin, Automotive Mechanics, 10$^{th}$ Ed., pp. 343–344, Glencoe McGraw-Hill (1995).

BRIEF SUMMARY OF THE INVENTION

The present invention is a method for highly reliable and durable electrical power distribution and a fusing block assembly for distributing large electrical currents to electrically-powered devices. The present invention apparatus is a machined distribution block of conductive material, typically metal, into which threaded connectors for input wires are affixed through the use of slip-joint ferrules which allow the connectors to be tightened securely to the distribution block without twisting the wires. Output connectors are threaded into the distribution block and are configured to securely hold tube-type fuses which are further electrically coupled to an output wire connector assembly. The output wire connector assembly also comprises slip-joint ferrules which similarly allow the connectors to be tightened securely without twisting the wires.

DESCRIPTION OF THE DRAWINGS

For fuller understanding of the present invention, reference is made to the accompanying drawing in the following section entitled Detailed Description of the Invention.

Reference numbers refer to the same or equivalent parts of the present invention throughout the several figures of the drawings.

DETAILED DESCRIPTION OF THE INVENTION

Figure 1:
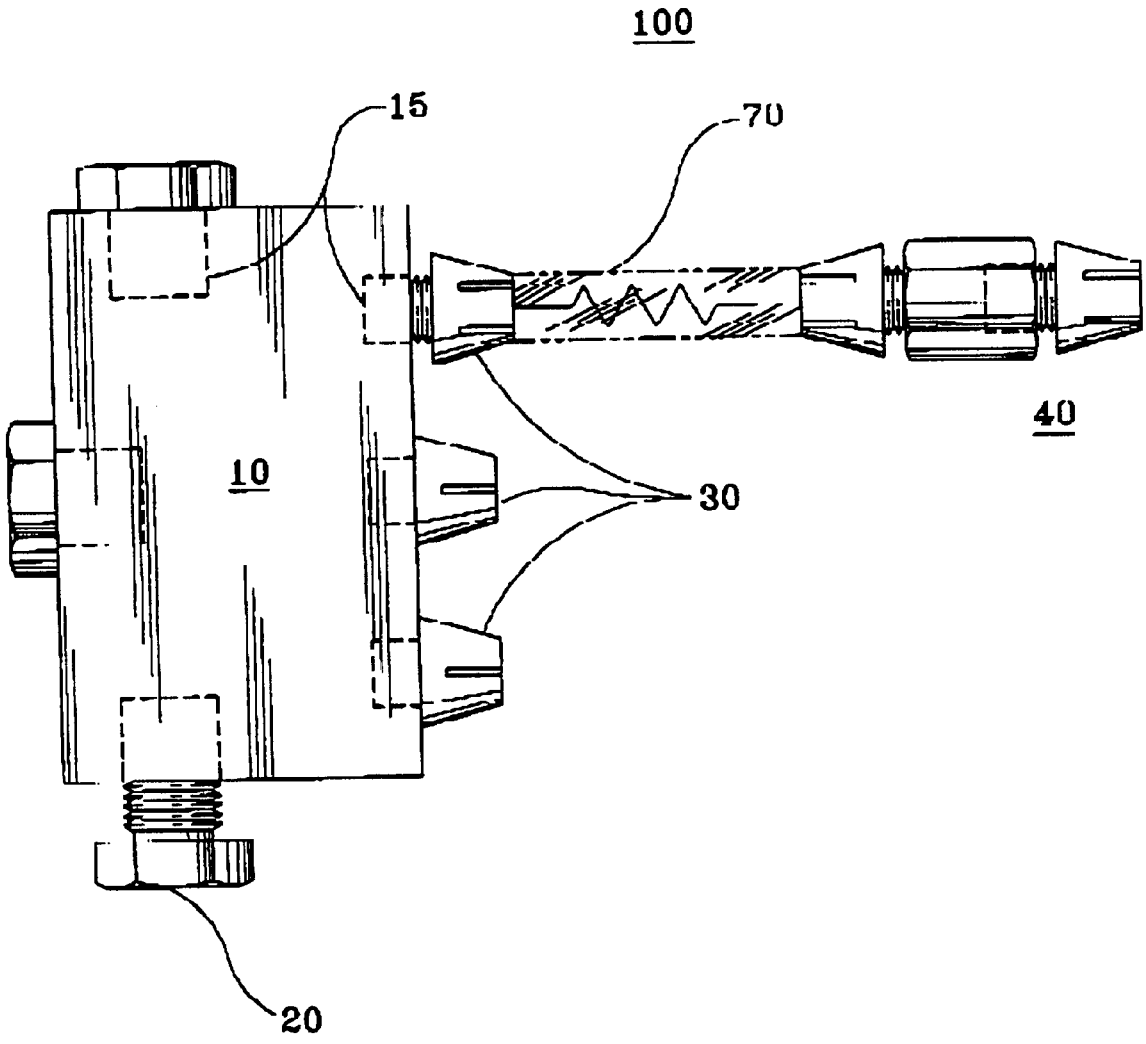
FIG. 1 is a plan view of the power fuse block, in accordance with the present invention.
Figure 7:
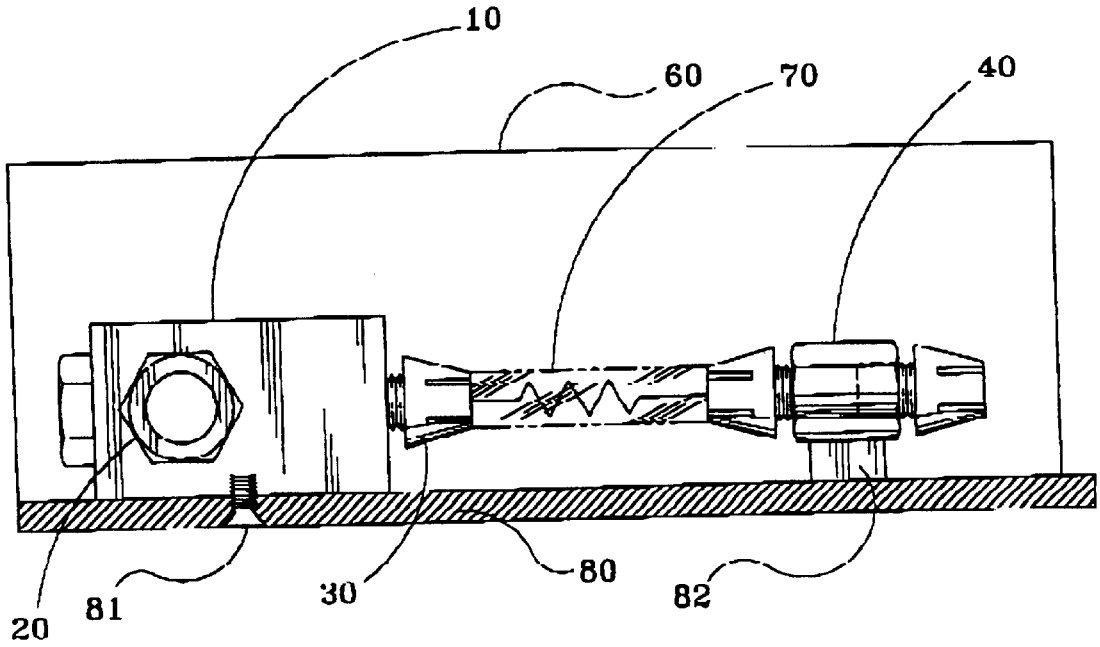
FIG. 7 is a side view of the power fuse block, in accordance with the present invention.

Referring to FIGS. 1 and 7, a partially assembled power fuse block 100 is shown. The major components are the power distribution block 10, input connector 20, output connector 30 and wire connector assembly 40. The electrically conductive components are constructed of compatible electrically conductive materials such as brass, stainless steel, or aluminum alloy, for example, and may be plated with non-oxidizing material such as gold or platinum for increased reliability. Also shown is tube fuse 70 comprising a glass cylinder with electrical connectors at each end and a fusible link therebetween within the glass cylinder. Power distribution block 10, also shown in side view in FIG. 7, is a solid rectangular block of electrically conductive material, such as stainless steel, aluminum, brass, or the like. Block 10 contains one or more threaded cavities 15 for receiving the input connectors 20 and output connectors 30. In the preferred embodiment, there are three cavities for receiving input connectors 20 and three for receiving output connectors 30, as below described. Block 10 also contains one or more threaded cavities, not shown, for receiving screws or bolts 81 for mounting block 10 to base 80, as shown in FIG. 7.

Figure 2:
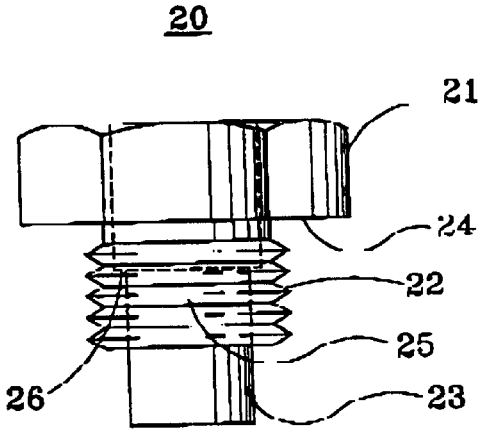
FIG. 2 is a side view of an input connector of the power fuse block, in accordance with the present invention.
Figure 3:
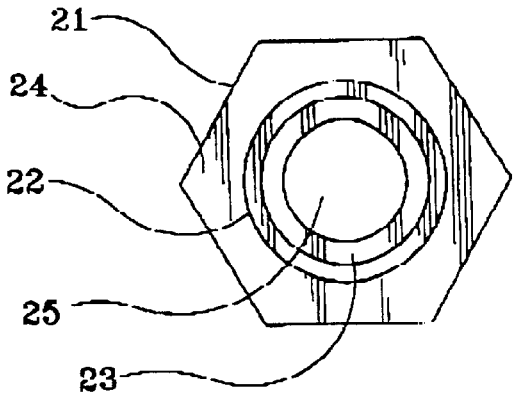
FIG. 3 is an end view of an input connector of the power fuse block, in accordance with the present invention.

Referring to FIGS. 2 and 3, an input connector 20 is shown. Input connector 20 has a head 21 which is faceted into a hexagonal nut. Head 21 is used to securely tighten connector 20 to block 10 during assembly of the power fuse block. Connector 20 has a threaded portion 22 which is dimensioned to match a corresponding cavity 15 in block 10, and which serves to secure connector 20 to block 10. One or more input connectors 20 may be used; the preferred configuration has three input connectors 20, as shown.

Ferrule 23 is a hollow cylinder having a rim 26 formed inside cavity 25 which retains ferrule 23 inside connector 20 but allows it to rotate freely. An input wire, not shown, is fastened inside of ferrule 23 by a compression fit, so as to secure the wire to connector 20 but allow it to rotate relative to connector 20. When connector 20 is threaded into cavity 15 of block 10, ferrule 23 allows connector 20 to rotate without twisting the connected wire. Ferrule 23 is brought into intimate electrical contact with block 10 through connector 20 when shoulder 24 is tightened against block 10. Input connector 20 is made of an electrically conductive material compatible with the material of block 10.

Figure 4:
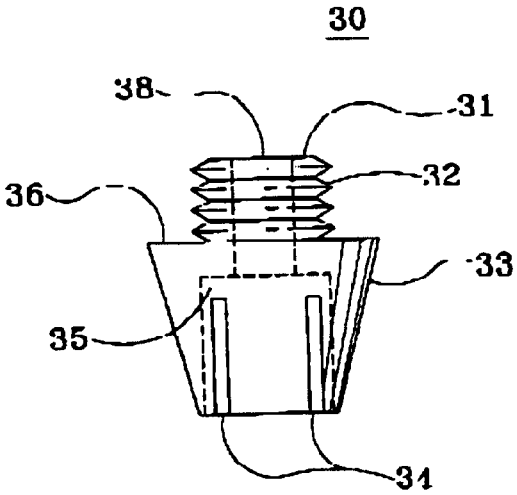
FIG. 4 is a side view of an output connector of the power fuse block, in accordance with the present invention.
Figure 5:
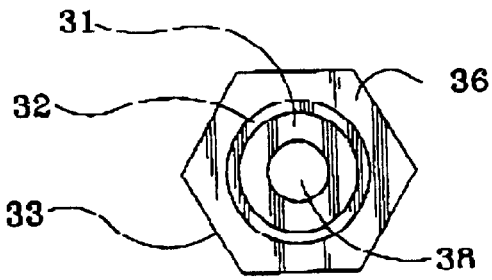
FIG. 5 is an end view of an output connector of the power fuse block, in accordance with the present invention.

Referring to FIGS. 4 and 5, an output connector 30 is shown. Connector 30 is formed from a single piece of electrically conductive material compatible with the material of block 10 and has two features, a threaded portion 32 and a fuse receiver 33. Alternatively, threaded portion 32 could be left unthreaded and pressed into a matching cavity in block 10.

Fuse receiver 33 is a hollow portion having a hexagonally faceted exterior and internal cavity 35 dimensioned to securely hold one end of a tube fuse. Fuse receiver 33 has an external surface faceted to accept a tool for tightening connector 30 into cavity 15 for securing connector 30 into block 10. Expansion slots 34 allow for cavity 35 to be slightly undersized, allowing fingers 37 to flex slightly outward when a fuse 70 is inserted into cavity 35, thereby securely holding fuse 70 in electrical contact with connector 30. An opening 38 is bored through connector 30 between face 31 and cavity 35. Connector 30 is inserted with face 31 first into cavity 15 of block 10 and connector 30 is securely tightened until shoulder 36 contacts the surface of block 10 by use of a tool fitting the external faceted surface of receiver 33.

Figure 6:
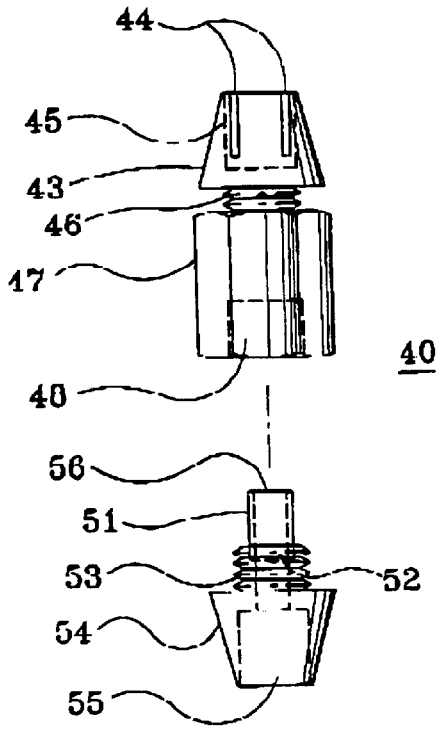
FIG. 6 is an exploded view of a wire connector assembly of the power fuse block, in accordance with the present invention.

Referring to FIG. 6, a wire connector assembly 40 is shown. Wire connector assembly 40 consists of two components, a fuse receptacle assembly 41 and a wire terminal 50. Fuse receptacle assembly 41 consists of a fuse receiver 43 which has expansion slots 44 and cavity 45 for receiving and holding a fuse, as above described, for the output connector 30. Fuse receiver 43 is connected to wire receiver 47 by neck 46, a solid piece of material. Wire receiver 47 has a threaded cavity 48 dimensioned to receive the threaded portion 53 of wire terminal 50. Wire receiver 47 has an external surface faceted to accept a tool for tightening the fuse receptacle assembly 41 to wire terminal 50.

Wire terminal 50 has a captive ferrule 51 formed and retained in cavity 52 in a manner similar to ferrule 23, above described. Threaded portion 53 is dimensioned to screw into cavity 48. The head 54 is formed with a faceted exterior surface for receiving a tool for tightening terminal 50 into assembly 41 at cavity 45. Head 54 has a cavity 55 into which an output wire is inserted to allow the wire to be secured to ferrule 51. In use, an output wire, not shown, is inserted through cavity 55 and opening 56, then secured inside ferrule 51 by a compression fit. Ferrule 51 is free to rotate within head 54, allowing terminal 50 to be screwed into assembly 41 at cavity 48 without twisting the output wire.

Referring to FIG. 7, the power fuse block is shown in side view. Block 10 is secured to insulating base 80 by screws or bolts 81. Wire connector assembly 40 is supported in saddle 82. A clear, insulating cover 60 is fitted over the entire power fuse block and detachably attached to base 80 to provide protection from the energized unit and yet allow a user to observe if a fuse is blown. Saddles placed to coincide with necks 46 are formed within the interior of cover 60 to aid in retaining wire connector assembly 40 in position and separated from parallel units. Gaps are formed in the perimeter of cover 60 to allow egress of the input and output wires as is known in the art.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims. Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, it should be readily apparent to those of ordinary skill in the art that various changes and modifications in form, semiconductor material, and fabrication material detail may be made without departing from the spirit and scope of the inventions as set forth in the appended claims. No claim herein is to be construed under the provisions of 35 U.S.C. 112, sixth paragraph, unless the element is expressly recited using the phrase "means for."

What is claimed:

1. An electrical power distribution fuse block, comprising:

means for receiving an input power through a rotatable connection;

means for distributing said power;

detachable means for holding at least one power fuse by fully enclosing each end of said fuse; and means for outputting said power through a rotatable connection, said fuse being disposed between the fuse holding means and the power outputting means.

2. The fuse block, as recited in claim 1, wherein the power receiving means is threadably attachable to the power distributing means.

3. The fuse block, as recited in claim 1, wherein the fuse holding means is threadably attachable to the power distributing means.

4. The fuse block, as recited in claim 1, wherein the power receiving means, the power distributing means, the fuse holding means, and the power outputting means are plated with a non-oxidizing electrically conductive material.

5. The fuse block, as recited in claim 1, wherein the power distributing means is secured to an electrically insulating base.

6. The fuse block, as recited in claim 1, further comprising a clear electrically insulating cover over the power receiving means, the power distributing means, the fuse holding means, and the power outputting means, the clear electrically insulating cover being detachably mounted to the electrically insulating base.

7. An electrical power distribution fuse block, comprising:

means for distributing power;

at least one power input connector being threadably attached to the power distributing means and to an input wire through a rotatable connection;

at least one means for holding and fully enclosing a first end of at least one fuse, the at least one fuse holding means being threadably attached to the power distributing means;

at least one power output connector corresponding to the at least one fuse holding means, the at least one power output connector comprising a connector body, a threadably attached output connector fuse holding means for holding and fully enclosing a second end of the at least one fuse, and means for holding a rotatable output wire connector, the connector body being disposed between the output connector fuse holding means and the output wire holding means, the output wire holding means being disposed between the connector body and the output wire; and at least one tube fuse, the at least one tube fuse being disposed between the fuse holding means and the output connector fuse holding means.

8. The fuse block, as recited in claim 7, wherein the power distributing means, the at least one power input connector, the at least one fuse holding means, and the at least one power output connector are plated with a non-oxidizing electrically conductive material.

9. The fuse block, as recited in claim 7, wherein the power distributing means is secured to an electrically insulating base.

10. The fuse block, as recited in claim 7, further comprising a clear electrically insulating cover over the at least one power input connectors the at least one fuse holding means, and the at least one power output connector, the clear electrically insulating cover being detachably mounted to the electrically insulating base.

11. A method for distributing electrical power using a fuse block, comprising:

providing means for receiving power through a rotatable connection;

providing means for distributing the power;

providing detachable means for holding a fuse by fully enclosing each end of the fuse; and providing means for outputting the power through a rotatable connection, the fuse being disposed between the fuse holding means and the power outputting means.

12. The method, as recited in claim 11, wherein the power receiving means is threadably attachable to the power distribution means.

13. The method, as recited in claim 11, wherein the fuse holding means is threadably attachable to the power distributing means.

14. The method, as recited in claim 11, wherein the components except for the fuse are plated with a non-oxidizing electrically conductive material.

15. The method, as recited in claim 11, wherein the power distributing means is secured to an electrically insulating base.

16. The method, as recited in claim 11, further comprising a clear electrically insulating cover over the power receiving means, the power distributing means, the fuse holding means, and the power outputting means, the clear electrically insulating cover being detachably mounted to the electrically insulating base.

17. A method for distributing electrical power using a fuse block, comprising:

providing means for distributing power;

providing at least one power input connector being threadably attached to the power distributing means and rotatably connected to an input electrical wire;

providing at least one means for holding at least one fuse, the at least one fuse holding means being threadably attached to the power distributing means and fully enclosing a first end of the fuse;

providing at least one power output connector corresponding to the at least one fuse holding means, the at least one power output connector comprising a connector body, an output connector fuse holding means for fully enclosing and holding a second end of the fuse, and means for holding a rotatable output wire connector, the connector body being disposed between the output connector fuse holding means and the output wire holding means, the output wire holding means being disposed between the connector body and the output wire; and providing at least one tube fuse, the at least one tube fuse being disposed between the fuse holding means and the output connector fuse holding means.

18. The method, as recited in claim 17, wherein the power distributing means, the at least one power input connector, the at least one fuse holding means, and the at least one power output connector are plated with a non-oxidizing electrically conductive material.

19. The method, as recited in claim 17, wherein the distribution means is secured to an electrically insulating base.

20. The method, as recited in claim 17, further comprising a clear electrically insulating cover over the power distributing means, the at least one power input connector, the at least one fuse holding means, and the at least one power output connector, the clear electrically insulating cover being and detachably mounted to the electrically insulating base.

* * * * *